US010308036B2

(12) United States Patent
Zhao et al.

(10) Patent No.: US 10,308,036 B2
(45) Date of Patent: Jun. 4, 2019

(54) PRINTHEAD, PRINTING EQUIPMENT AND PRINTING METHOD

(71) Applicant: BOE Technology Group Co., Ltd., Beijing (CN)

(72) Inventors: Dejiang Zhao, Beijing (CN); Yang Yang, Beijing (CN); Xiaojie Pan, Beijing (CN); Bin Bu, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 15/962,155

(22) Filed: Apr. 25, 2018

(65) Prior Publication Data

US 2019/0030912 A1 Jan. 31, 2019

(30) Foreign Application Priority Data

Jul. 27, 2017 (CN) ..... 2017 1 0624809

(51) Int. Cl.

| | |
|---|---|
| ***B41J 2/14*** | (2006.01) |
| ***B41J 2/185*** | (2006.01) |
| ***B41J 2/145*** | (2006.01) |
| ***B41J 2/165*** | (2006.01) |
| ***B41J 2/17*** | (2006.01) |
| ***B41J 2/02*** | (2006.01) |
| *B41J 2/04* | (2006.01) |

(52) U.S. Cl.

CPC ..... *B41J 2/185* (2013.01); *B41J 2/02* (2013.01); *B41J 2/145* (2013.01); *B41J 2/14201* (2013.01); *B41J 2/16517* (2013.01); *B41J 2/1721* (2013.01); *B41J 2002/043* (2013.01); *B41J 2002/14467* (2013.01)

(58) Field of Classification Search

CPC ..... B41J 2/185; B41J 2/16517; B41J 2/1721; B41J 2/145; B41J 2/14201; B41J 2002/14467; B41J 2002/043; B41J 2/02

See application file for complete search history.

(56) References Cited

U.S. PATENT DOCUMENTS

| | | | | |
|---|---|---|---|---|
| 2003/0039169 | A1* | 2/2003 | Ehrfeld | B01F 5/0604 366/336 |
| 2008/0049084 | A1* | 2/2008 | Katada | B41J 2/18 347/92 |
| 2014/0026968 | A1* | 1/2014 | Abate | B01L 3/502784 137/1 |

* cited by examiner

*Primary Examiner* — Yaovi M Ameh

(74) *Attorney, Agent, or Firm* — Westman, Champlin & Koehler, P.A.

(57) ABSTRACT

Embodiments of the present disclosure provide a printhead, a printing equipment and a printing method. The printhead includes: a primary liquid discharging assembly, including a plurality of primary liquid discharging nozzles for forming primary droplets; and a plurality of flow branching components below the primary liquid discharging assembly, and the plurality of flow branching components being in one-to-one correspondence with the plurality of primary liquid discharging nozzles, wherein each of the plurality of flow branching component is configured to be in contact with the primary droplet formed by the corresponding primary liquid discharging nozzle of the plurality of primary liquid discharging nozzles, and split each of the primary droplets into at least two branched droplets.

20 Claims, 6 Drawing Sheets

PRINTHEAD, PRINTING EQUIPMENT AND PRINTING METHOD

CROSS-REFERENCE TO RELATED APPLICATION

This application claims the benefit of Chinese Patent Application No. 201710624809.5 filed on Jul. 27, 2017 in the State Intellectual Property Office of China, the disclosure of which is incorporated herein by reference in entirety.

BACKGROUND

Technical Field

Embodiments of the present disclosure relate to the field of display product manufacturing technology, and in particular, to a printhead, a printing equipment and a printing method.

Description of the Related Art

At present, in the field of display product manufacturing technology, a film layer is generally formed on a substrate by vapor deposition, sputtering, or the like, and then a corresponding pattern is formed on the film layer by a photolithographic process or the like. However, when the above method is used to manufacture a display product, it is necessary to perform a photolithographic process to etch away some parts of the film layer, resulting in a low utilization rate of material. In order to increase the utilization rate of material, a printing method may generally be adopted. The printing method is implemented by ejecting droplets onto a substrate by a printhead to form a corresponding pattern on the substrate. When a printing method is used, it is unnecessary to adopt such as the photolithographic process to etch away some parts of the film layer to form the corresponding pattern, instead, the droplets are directly dropped onto the substrate to form the corresponding pattern. Therefore, a method of manufacturing a display product using a printing method has a high utilization rate of material, thus more and more display product manufacturer's attention is drawn to it.

The printing method is generally implemented by using a printing equipment. The printing equipment includes a printhead in which a plurality of nozzles are disposed. Droplets are ejected onto the substrate by the nozzles in the printhead to realize a manufacture of the display product. However, in such a printing equipment, due to limitation of structure and working manner of the nozzles in the printhead, it is difficult to control the droplets ejected from the nozzles in the relevant art, and thus it is difficult to obtain a display product with a higher resolution when adopting such a printing equipment to manufacture the display product.

SUMMARY

The embodiments of the present disclosure provide the following technical solutions:

A printhead, comprising:

a primary liquid discharging assembly, comprising a plurality of primary liquid discharging nozzles for forming primary droplets; and a plurality of flow branching components below the primary liquid discharging assembly, and the plurality of flow branching components being in one-to-one correspondence with the plurality of primary liquid discharging nozzles, wherein each of the plurality of flow branching components is configured to be in contact with the primary droplet formed by the corresponding primary liquid discharging nozzle, and to split each of the primary droplets into at least two branched droplets.

Optionally, the printhead further comprises a plurality of secondary liquid discharging channels below the primary liquid discharging assembly, the plurality of secondary liquid discharging channels being in one-to-one correspondence with the plurality of flow branching components, wherein each of the flow branching components is located in a corresponding secondary liquid discharging channel of the plurality of secondary liquid discharging channels, and the each of the flow branching component is configured to separate the corresponding secondary liquid discharging channel into at least two branching channels, and in the at least two branched droplets formed from the primary droplet which is split by the each of the flow branching components, each of the branched droplets flows through a corresponding branching channel.

Optionally, each of the flow branching components comprises a tine, and a tip of the tine is directed towards a corresponding primary liquid discharging nozzle of the plurality of primary liquid discharging nozzles.

Optionally, a distance between a channel wall of each of the secondary liquid discharging channels and the corresponding primary liquid discharging nozzle is less than a distance between the tine and the corresponding primary liquid discharging nozzle.

Optionally, the printhead further comprises a plurality of secondary liquid discharging channels below the primary liquid discharging assembly, the plurality of secondary liquid discharging channels being in one-to-one correspondence with the plurality of flow branching components, wherein each of the flow branching components is located in an opening of a corresponding secondary liquid discharging channel of the plurality of secondary liquid discharging channels close to a corresponding primary liquid discharging nozzle of the plurality of primary liquid discharging nozzles, and in the at least two branched droplets formed from each of the primary droplets which is split by a corresponding flow branching component of the plurality of flow branching components, one of the branched droplets flows through the corresponding secondary liquid discharging channel, and the remaining branched droplets are diverted to an outside of the secondary liquid discharging channels.

Optionally, each of the flow branching components comprises a tine disposed on a channel wall of the corresponding secondary liquid discharging channel, and a tip of the tine is directed towards the corresponding primary liquid discharging nozzle.

Optionally, each of the flow branching components further comprises a shielding wall disposed on the channel wall of the corresponding secondary liquid discharging channel and facing the tine, and a distance between the shielding wall and the corresponding primary liquid discharging nozzle is less than a distance between the tine and the corresponding primary liquid discharging nozzle.

Optionally, each of the flow branching components further comprises a flow guiding slot on a side of the tine facing away from the secondary liquid discharging channel.

Optionally, the shielding wall is flush with a corresponding channel wall in channel walls of a primary liquid discharging channel of the corresponding primary liquid discharging nozzle, and a distance between the tine and the shielding wall is less than a distance between the channel wall corresponding to the shielding wall and the channel wall corresponding to the tine, in the channel walls of the primary liquid discharging channels of the primary liquid discharging nozzles.

Optionally, the distance between the tine and the shielding wall is ⅓ to ¾ of the distance between the channel wall corresponding to the shielding wall and the channel wall corresponding to the tine, in the channel walls of the primary liquid discharging channels of the primary liquid discharging nozzles.

Optionally, the distance between the tine and the shielding wall is ½ of the distance between the channel wall corresponding to the shielding wall and the channel wall corresponding to the tine, in the channel walls of the primary liquid discharging channels of the primary liquid discharging nozzles.

Optionally, an apex angle of the tine is variable.

Optionally, the tine is made of a piezoelectric material.

Optionally, the printhead further comprises a first static electricity generator on an opening of the secondary liquid discharging channel away from the corresponding primary liquid discharging nozzle.

Optionally, the channel wall of the primary liquid discharging channel of the primary liquid discharging nozzle is made of a piezoelectric material.

Optionally, the printhead further comprises a partition plate between the primary liquid discharging assembly and the secondary liquid discharging channels, the partition plate being provided with a plurality of through holes, the plurality of through holes being in one-to-one correspondence with the plurality of primary liquid discharging nozzles, and a cross-sectional area of the through hole being greater than a cross-sectional area of the primary liquid discharging channel of the corresponding primary liquid discharging nozzle of the plurality of primary liquid discharging nozzles.

The embodiments of the present disclosure provide the following technical solutions:

A printing equipment, comprising the printhead according to the foregoing technical solutions.

Optionally, the printing equipment comprises a stage below the printhead, a second static electricity generator is on the stage, and the second static electricity generator is configured to generate an electrical property of static electricity that is opposite to an electrical property of static electricity generated by the first static electricity generator in the printhead.

Optionally, the printing equipment further comprises a liquid supply system, a recovery system, and a waste liquid system, wherein the liquid supply system is communicated with a liquid inlet of the primary liquid discharging assembly of the printhead;

the recovery system is communicated with the liquid supply system, a liquid outlet of the primary liquid discharging assembly, and a flow guiding slot of the flow branching components of the printhead, and a switching valve is provided in a pipeline communicating the flow guiding slot with the recovery system; and the waste liquid system is communicated with the liquid outlet of the primary liquid discharging assembly and the flow guiding slot.

The embodiments of the present disclosure provide the following technical solutions:

A printing method using the printhead according to the foregoing technical solutions, wherein the printing method comprises:

forming the primary droplets by the primary liquid discharging nozzles of the primary liquid discharging assembly; and making each of the flow branching components in contact with the primary droplet formed by the corresponding primary liquid discharging nozzle and splitting the primary droplet into at least two branched droplets.

Optionally, after making each of the flow branching components in contact with the primary droplet formed by the corresponding primary liquid discharging nozzle and splitting the primary droplet into at least two branched droplets, the printing method further comprises:

generating static electricity by a first static electricity generator to charge the branched droplets flowing through secondary liquid discharging channels;

generating by a second static electricity generator static electricity having an electrical property of static electricity that is opposite to an electrical property of static electricity generated by the first static electricity generator, to form an electric field between the printhead and a stage; and dropping the charged branched droplets onto a substrate placed on the stage.

Optionally, before forming the primary droplets by the primary liquid discharging nozzles of the primary liquid discharging assembly, the printing method further comprises:

supplying a printing liquid by a liquid supply system to the primary liquid discharging assembly of the printhead;

after making each of the flow branching components in contact with the primary droplet formed by the corresponding primary liquid discharging nozzle and splitting the primary droplet into at least two branched droplets, the printing method further comprises:

directing the printing liquid in the primary liquid discharging assembly that does not form primary droplets and the printing liquid in the flow guiding slot of the flow branching component into a recovery system; and introducing the printing liquid in the recovery system into the liquid supply system.

Optionally, the printing method further comprises:

directing the printing liquid in the primary liquid discharging assembly that does not form primary droplets and the printing liquid in a flow guiding slot of the flow branching component into a waste liquid system, and cleaning the primary liquid discharging assembly and the flow guiding slot.

BRIEF DESCRIPTION OF THE DRAWINGS

The drawings listed herein are provided to provide a further understanding of the embodiments of the present disclosure, and constitute a part of the embodiments of the present disclosure. The exemplary embodiments of the present disclosure and the description thereof are used to explain the present disclosure, but do not improperly limit the present disclosure. In the drawings.

DETAILED DESCRIPTION OF PREFERRED EMBODIMENTS

Figure 1:
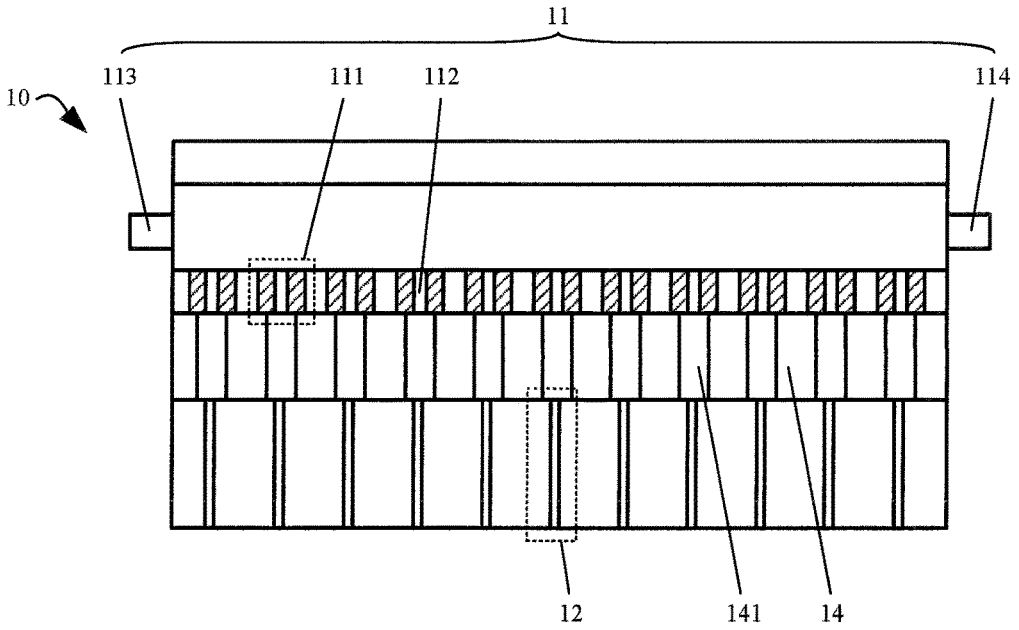
FIG. 1 is a schematic structural view of a printhead according to an embodiment of the present disclosure.

In order to further describe the printhead, the printing equipment, and the printing method according to the embodiments of the present disclosure, the embodiments will be described in detail in conjunction with the accompanying drawings.

Referring to FIG. 1 to FIG. 6, a printhead 10 according to an embodiment of the present disclosure comprises: a primary liquid discharging assembly 11, comprising a plurality of primary liquid discharging nozzles 111 for forming primary droplets; and a plurality of flow branching components 13 located below the primary liquid discharging assembly 11, and the plurality of flow branching components 13 are in one-to-one correspondence with the plurality of primary liquid discharging nozzles 111. The flow branching component 13 can be configured to be in contact with the primary droplet formed by the corresponding primary liquid discharging nozzle 111, and branch the primary droplet into at least two branched droplets.

Figure 2:
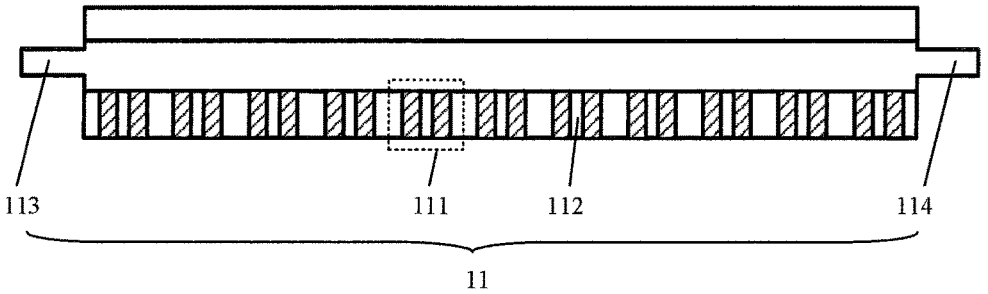
FIG. 2 is a schematic structural view of a primary liquid discharging device in FIG. 1.

For example, the printhead 10 according to the embodiment of the present disclosure is used in a printing equipment to form a corresponding pattern on a substrate by using a printing process, to manufacture a display product, such as a liquid crystal display product or an organic light-emitting diode (OLED) display product, etc. The printhead 10 according to the embodiment of the present disclosure includes a primary liquid discharging assembly 11 and flow branching components 13. Referring to FIG. 2, the primary liquid discharging assembly 11 comprises a plurality of primary liquid discharging nozzles 111 arranged in an array, or arranged in a row or a column. Each of the primary liquid discharging nozzles 111 comprises a primary liquid discharging channel 112, and each of the primary liquid discharging nozzles 111 can form primary liquid droplets from a printing liquid introduced into the primary liquid discharging assembly 11. The primary liquid droplets flow out through the primary liquid discharging channel 112 of the corresponding primary liquid discharging nozzle 111. A plurality of the flow branching components 13 are located below the primary liquid discharging assembly 11, and the plurality of flow branching components 13 are in one-to-one correspondence with the plurality of primary liquid discharging nozzles 111, that is, one flow branching component 13 is provided below each primary liquid discharging nozzle 111. The flow branching component 13 can be in contact with the primary droplet formed by the corresponding primary dispensing nozzle 111 and split the primary droplet into at least two branched droplets. In the at least two branched droplets formed from the primary droplet which is split by the flow branching component 13, at least one branched droplet is dropped onto the substrate to form the corresponding pattern.

Therefore, in the printhead according to the embodiment of the present disclosure, the primary droplets are formed by the primary liquid discharging nozzle 111 in the primary liquid discharging assembly 11, and the primary droplets formed by the primary liquid discharging nozzle 111 are split by the corresponding flow branching component 13, to form at least two branched droplets, so that a volume of each branched droplet is reduced in comparison with a volume of the primary droplet, and then the branched droplets are dropped onto the substrate to form the corresponding pattern. Thus the droplets falling on the substrate are controlled, especially the volume of the droplet falling on the substrate is reduced, so that the pattern formed on the substrate can be controlled. In this way, the precision of the pattern formed on the substrate can be improved, and a display product with a higher resolution can be manufactured.

It should be noted that, in the printhead 10 according to the embodiment of the present disclosure, the number of the primary liquid discharging assemblies 11 may be one, or may be more than one. If the number of the primary liquid discharging assemblies 11 is more than one, the plurality of primary liquid discharging assemblies 11 are stacked in order above the flow branching component 13, and in two adjacent ones of the primary liquid discharging assemblies 11, the primary liquid discharging channel 112 of the primary liquid discharging nozzle 111 in the upper primary liquid discharging assembly 11 has a cross-sectional area greater than that of the primary liquid discharging channel 112 of the primary liquid discharging nozzle 111 in the lower primary liquid discharging assembly 11. With such a design, from top to bottom, the cross-sectional areas of the primary liquid discharging channels 112 of the primary liquid discharging nozzles 111 in the primary liquid discharging assemblies 11 gradually decrease, and the volumes of the formed primary droplets also gradually decrease, thereby the droplet falling on the substrate is controlled, especially the volume of the droplet falling on the substrate is controlled, to achieve a display product with a higher resolution.

Similarly, in the printhead 10 according to the embodiment of the present disclosure, the number of the flow branching components 13 may be one to form one stage of branching, or may be more than one to form multiple stages of branching. If the flow branching components 13 are set in multiple stages, the multiple stages of flow branching components 13 are stacked in order below the primary liquid discharging assembly 11, and in adjacent two stages of the multiple stages of flow branching components 13, the lower flow branching component 13 can be in contact with the branched droplet which is formed by a branching operation of the upper flow branching component 13, and further split the branched droplet which is formed by the branching operation of the upper flow branching component 13. In this way, from top to bottom, the volumes of the droplets formed by the flow branching components 13 gradually decrease, thereby the droplet falling on the substrate is controlled, especially the volume of the droplet falling on the substrate is controlled, to achieve a display product with a higher resolution.

In the above embodiment, the flow branching component 13 is in contact with the primary droplet formed by the corresponding primary liquid discharging nozzle 111, to split the primary droplet into at least two branched droplets, then all the branched droplets can be made to pass through the corresponding channels respectively to fall on the substrate to form a corresponding pattern. Specifically, referring to FIG. 3 and FIG. 4, the printhead according to the embodiment of the present disclosure further comprises a plurality of secondary liquid discharging channels 12 located below the primary liquid discharging assembly 11, the plurality of secondary liquid discharging channels 12 are in one-to-one correspondence with the plurality of flow branching components 13. The flow branching component 13 is located in a corresponding secondary liquid discharging channel 12, and the flow branching component 13 is configured to separate the corresponding secondary liquid discharging channel 12 into at least two branching channels 121, and branched droplets are formed from the primary droplet which is split by the flow branching component 13, and each of the at least two branched droplets flows through a corresponding branching channel 121. For example, further referring to FIG. 3 and FIG. 4, the flow branching component 13 is provided in a corresponding secondary liquid discharging channel 12, and the flow branching component 13 separates the secondary liquid discharging channel 12 into two branching channels 121. After the primary droplet is split by the flow branching component 13, two branched droplets may be formed. One branched droplet falls onto the substrate through one branching channel 121, and the other branched droplet falls onto the substrate through the other branching channel 121, i.e., two branched droplets respectively fall onto the substrate through the corresponding flow branching channels 121 to respectively form corresponding patterns. With such a design, all the branched droplets formed from the primary droplet which has been split can be dropped onto the substrate to form corresponding patterns, thus it can increase the utilization rate of material and reduce material waste.

Figure 3:
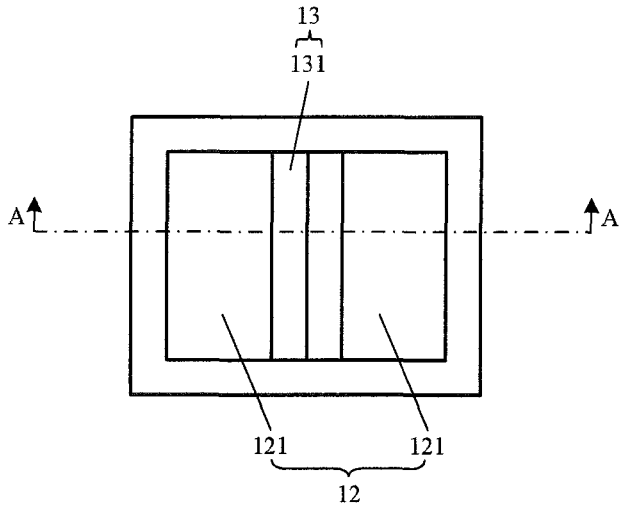
FIG. 3 is a schematic structural view of a secondary liquid discharging channel in FIG. 1.
Figure 4:
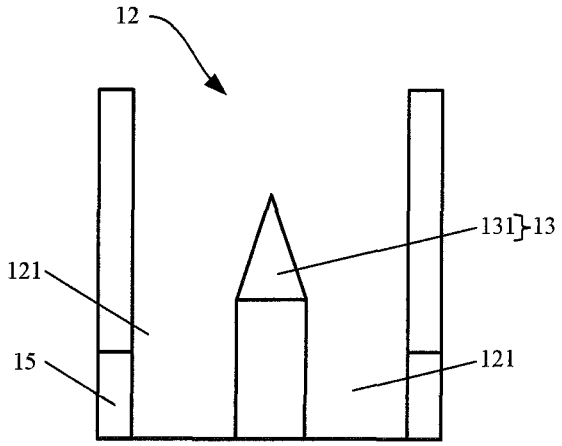
FIG. 4 is a cross sectional view along A-A in FIG. 3.

Further referring to FIG. 3 and FIG. 4, in the embodiment of the present disclosure, the flow branching component 13 may comprise a tine 131, and a tip of the tine 131 is directed towards the corresponding primary liquid discharging nozzle 111. For example, further referring to FIG. 3 and FIG. 4, the tine 131 is located in the secondary liquid discharging channel 12, and separates the secondary liquid discharging channel 12 into two flow branching channels 121. The primary droplet enters the secondary liquid discharging channel 12, contacts with the tip of the tine 131, and is split into two parts by the tip of the tine 131, forming two branched droplets. The two branched droplets fall on the substrate through the corresponding branching channels 121 to form corresponding patterns.

Referring to FIG. 4, in the embodiment of the present disclosure, a distance between a channel wall of the secondary liquid discharging channel 12 and the corresponding primary liquid discharging nozzle 111 is less than a distance between the tine 131 and the corresponding primary liquid discharging nozzle 111. That is to say, the tine 131 is located in the secondary liquid discharging channel 12, the tip of the tine 131 is directed towards the corresponding primary liquid discharging nozzle 111, and the tip of the tine 131 is lower than an opening of the secondary liquid discharging channel 12 facing the corresponding primary liquid discharging nozzle 111. Therefore, when the primary droplet enters the secondary liquid discharging channel 12, it at first contacts with the channel wall of the secondary liquid discharging channel 12 and falls down along the channel wall of the secondary liquid discharging channel 12, and then the primary droplet contacts with the tine 131. When the primary droplet is in contact with the tine 131, the channel wall of the secondary liquid discharging channel 12 can block the primary droplet, and prevent the primary droplet from shifting due to the force caused by the contact with the tine 131.

In the above embodiment, the flow branching component 13 is in contact with the primary droplet formed by the corresponding primary liquid discharging nozzle 111, to split the primary droplet into at least two branched droplets, and it is also possible to allow a portion of the branched droplets to fall on the substrate through the corresponding channel, to form a corresponding pattern. Specifically, referring to FIG. 5 to FIG. 6, the printhead according to an embodiment of the present disclosure further comprises a plurality of secondary liquid discharging channels 12 located below the primary liquid discharging assembly 11. The plurality of secondary liquid discharging channels 12 are in one-to-one correspondence with the plurality of flow branching components 13. The flow branching component 13 is located in an opening of a corresponding secondary liquid discharging channel 12 close to the corresponding primary liquid discharging nozzle 111, and at least two branched droplets are formed from the primary droplet which is split by the flow branching component 13. One of the branched droplets flows through the corresponding secondary liquid discharging channel 12, and the remaining branched droplets are diverted to an outside of the secondary liquid discharging channel 12. For example, further referring to FIG. 5 and FIG. 6, the flow branching component 13 is provided on the channel wall of the corresponding secondary liquid discharging channel 12, and the flow branching component 13 is located in the opening the secondary liquid discharging channel 12 facing the corresponding primary liquid discharging nozzle 111. When the primary droplet enters the secondary liquid discharging channel 12, the flow branching component 13 can split the primary droplet into two branched droplets, and one of the branched droplets falls onto the substrate through the secondary liquid discharging channel 12 to form a corresponding pattern, and the other branched droplet is diverted by the flow branching component 13 to the outside of the secondary liquid discharging channel 12, and is no longer dropped onto the substrate through the secondary liquid discharging channel 12, thereby the droplet falling on the substrate is controlled, especially the volume of the droplet falling on the substrate is controlled, to achieve a display product with a higher resolution.

Figure 5:
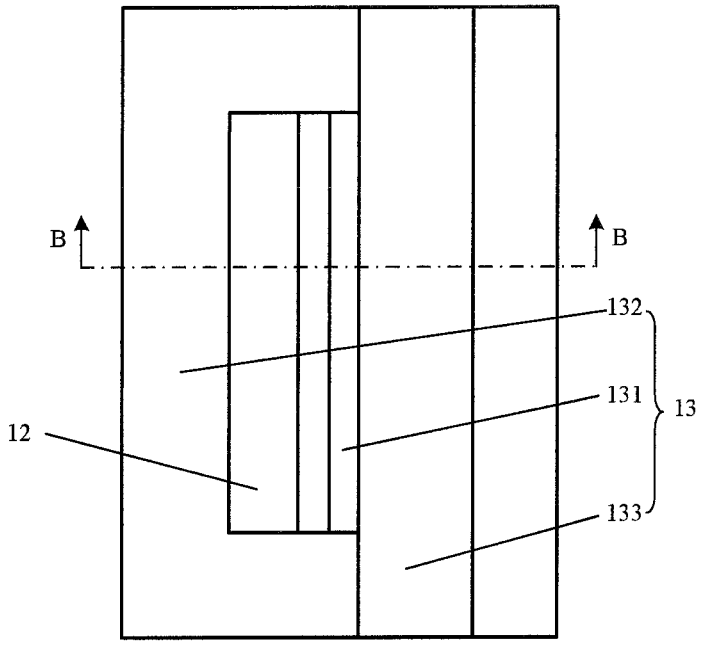
FIG. 5 is another schematic structural view of a secondary liquid discharging channel in FIG. 1.
Figure 6:
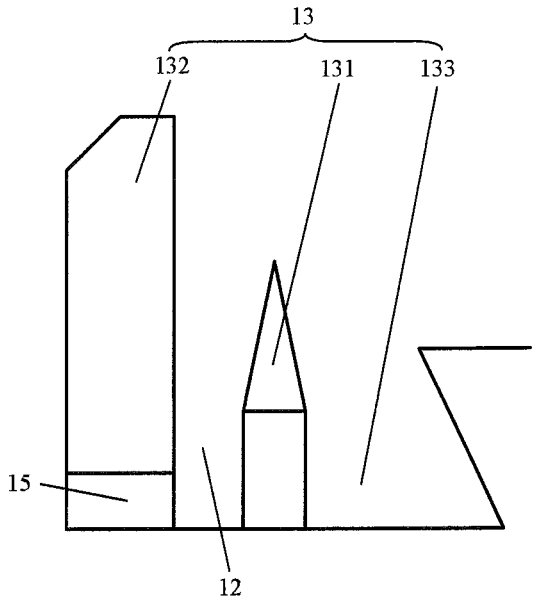
FIG. 6 is a cross sectional view along B-B in FIG. 5.

Further referring to FIG. 5 and FIG. 6, the flow branching component 13 may comprise a tine 131 disposed on a channel wall of the secondary liquid discharging channel 12, and a tip of the tine 131 is directed towards the corresponding primary liquid discharging nozzle 111. Specifically, the tine 131 may be disposed on a channel wall on one side of the secondary liquid discharging channel 12, and the tine 131 is directed towards the corresponding primary liquid discharging nozzle 111. One side of the tine 131 faces the secondary liquid discharging channel 12 and the other side faces away from the secondary liquid discharging channel 12. The primary droplet enters the secondary liquid discharging channel 12, contacts with the tine 131, and is split by the tip of the tine 131 to form two branched droplets. One of the branched droplets falls along the left side of the tine 131 in FIG. 6 and enters the secondary liquid discharging channel 12 and falls onto the substrate to form a corresponding pattern. The other branched droplet falls along the right side of the tine 131 in FIG. 6, and is directed to the outside of the secondary liquid discharging channel 12.

Further referring to FIG. 5 and FIG. 6, in the embodiment of the present disclosure, the flow branching component 13 further comprises a shielding wall 132 disposed on the channel wall of the secondary liquid discharging channel 12 and facing the tine 131, and a distance between the shielding wall 132 and the corresponding primary liquid discharging nozzle 111 is less than a distance between the tine 131 and the corresponding primary liquid discharging nozzle 111. For example, further referring to FIG. 5 and FIG. 6, the flow branching component 13 comprises a shielding wall 132 and a tine 131. The shielding wall 132 is located on a left channel wall of the secondary liquid discharging channel 12 in FIG. 5 or FIG. 6, and the tine 131 is located on a right channel wall of the secondary liquid discharging channel 12 in FIG. 5 or FIG. 6, and the shielding wall 132 is higher than the tine 131. When the primary droplet enters the secondary liquid discharging channel 12, the primary droplet at first contacts with the shielding wall 132 and falls down along the shielding wall 132, and then contacts with the tine 131 and is split by the tine 131 to form two branched droplets. One of the branched droplets falls along the left side of the tine 131 in FIG. 6 and enters the secondary liquid discharging channel 12 and falls onto the substrate to form a corresponding pattern. The other branched droplet falls along the right side of the tine 131 in FIG. 6, and is directed to the outside of the secondary liquid discharging channel 12. With such a design, when the primary droplet enters the secondary liquid discharging channel 12, the shielding wall 132 can block the primary droplet and prevent the primary droplet from falling down into the adjacent secondary liquid discharging channel 12. At the same time, when the primary droplet contacts with the tine 131, the shielding wall 132 can also block the primary droplet and prevent the primary droplet from shifting due to the force caused by the contact with the tine 131.

Further referring to FIG. 5 and FIG. 6, in the embodiment of the present disclosure, the flow branching component 13 further comprises a flow guiding slot 133 on a side of the tine 131 facing away from the secondary liquid discharging channel 12. For example, further referring to FIG. 5 and FIG. 6, the flow branching component 13 comprises a tine 131, a shielding wall 132, and a flow guiding slot 133. The tine 131 and the shielding wall 132 are respectively disposed on the channel walls of the secondary liquid discharging channel 12, and the tine 131 faces the shielding wall 132. An inlet of the secondary liquid discharging channel 12 is located between the tine 131 and the shielding wall 132, and the flow guiding slot 133 is located on a side of the tine 131 facing away from the secondary liquid discharging channel 12. It is also understood that the flow guiding slot 133 is located on a side of the tine 131 facing away from the shielding wall 132. When the primary droplet enters the secondary liquid discharging channel 12, the primary droplet at first contacts with the shielding wall 132 and falls along the shielding wall 132, then contacts with the tine 131, and is split by the tine 131 to form two branched droplets. One of the branched droplets falls along the left side of the tine 131 in FIG. 6 and enters the secondary liquid discharging channel 12 and falls onto the substrate to form a corresponding pattern. The other branched droplet falls along the right side of the tine 131 in FIG. 6, and is directed to the flow guiding slot 133. The arrangement of the flow guiding slot 133 can be used to receive the branched droplet directed to the outside of the secondary liquid discharging channel 12 by the tine 131 after the primary droplet contacting with the tine 131, so as to drain the branched droplet, to prevent the branched droplet from flowing into the adjacent secondary liquid discharging channel 12.

In the embodiment of the present disclosure, the shielding wall 132 is flush with a corresponding channel wall in channel walls of a primary liquid discharging channel 112 of the corresponding primary liquid discharging nozzle 111, and a distance between the tine 131 and the shielding wall 132 is less than a distance between the channel wall corresponding to the shielding wall 132 and the channel wall corresponding to the tine 131, in the channel walls of the primary liquid discharging channel 112 of the primary liquid discharging nozzle 111. For example, the distance between the tine 131 and the shielding wall 132 may be ⅓ to ¾ of the distance between the channel wall corresponding to the shielding wall 132 and the channel wall corresponding to the tine 131, in the channel walls of the primary liquid discharging channel 112 of the primary liquid discharging nozzle 111. Optionally, the distance between the tine 131 and the shielding wall 132 is ½ of the distance between the channel wall corresponding to the shielding wall 132 and the channel wall corresponding to the tine 131, in the channel walls of the primary liquid discharging channel 112 of the primary liquid discharging nozzle 111.

For example, in the embodiment of the present disclosure, the cross-sectional shape of the liquid discharging channel of the primary liquid discharging nozzle 111 may be a rectangle. Referring to FIG. 5, the cross-sectional shape of the secondary liquid discharging channel 12 is also a rectangle. The left side channel wall of the secondary liquid discharging channel 12 in FIG. 5 is flush with the channel wall in the primary liquid discharging nozzle 111 corresponding to the left side channel wall of the secondary liquid discharging channel 12 in FIG. 5. The upper side channel wall of the secondary liquid discharging channel 12 in FIG. 5 is flush with the channel wall in the primary liquid discharging nozzle 111 corresponding to the upper side channel wall of the secondary liquid discharging channel 12 in FIG. 5. The lower side channel wall of the secondary liquid discharging channel 12 in FIG. 5 is flush with the channel wall in the primary liquid discharging nozzle 111 corresponding to the lower side channel wall of the secondary liquid discharging channel 12 in FIG. 5. The right side channel wall of the secondary liquid discharging channel 12 in FIG. 5 is offset towards the left side channel wall of the secondary liquid discharging channel 12 in FIG. 5 relative to the channel wall in the primary liquid discharging nozzle 111 corresponding to the right side channel wall of the secondary liquid discharging channel 12 in FIG. 5, that is, a distance between the left side channel wall of the secondary liquid discharging channel 12 and the right side channel wall of the secondary liquid discharging channel 12 in FIG. 5 is less than a distance between two corresponding channel walls of the primary liquid discharging channel 112 in the primary liquid discharging nozzle 111. The shielding wall 132 is disposed on the left side channel wall of the secondary liquid discharging channel 12 in FIG. 5, and the tine 131 is disposed on the right side channel wall of the secondary liquid discharging channel 12 in FIG. 5. The shielding wall 132 is also flush with the channel wall in the primary liquid discharging nozzle 111 corresponding to the shielding wall 132, and the tine 131 is offset towards the shielding wall 132 relative to the channel wall in the primary liquid discharging channel 112 of the primary liquid discharging nozzle 111 corresponding to the tine 131, that is, a distance between the tine 131 and the shielding wall 132 is less than a distance between the channel wall corresponding to the shielding wall 132 and the channel wall corresponding to the tine 131 in the primary liquid discharging channel 112 of the primary liquid discharging nozzle 111. The distance between the tine 131 and the shielding wall 132 may be set to ⅓ to ¾, optionally ½, of the distance between the channel wall corresponding to the shielding wall 132 and the channel wall corresponding to the tine 131 in the channel walls of the primary liquid discharging channel 112 of the primary liquid discharging nozzle 111. With such a design, the primary droplet can be conveniently brought into contact with the shielding wall 132 when entering the secondary liquid discharging channel 12, and fall along the shielding wall 132 so that the primary droplet can be properly in contact with the tine 131 and be split by the tine 131 to form two branched droplets.

In the above embodiment, in order to further control the volume of the branched droplet falling onto the substrate through the secondary liquid discharging channel 12, the tine 131 can be set as a tine 131 with a variable apex angle. By changing the apex angle of the tine 131, the volume of the two branched droplets formed by splitting the primary droplet by the tine 131 may be controlled, thereby further controlling the volume of the branched droplet falling onto the substrate through the secondary liquid discharging channel 12.

In the above embodiment, if the tine 131 is set as the tine 131 with a variable apex angle, the material of the tine 131 can be selected as a deformable material. For example, the tine 131 may be made of a deformable material, optionally piezoelectric material, such as piezoelectric ceramic, piezoelectric crystal, piezoelectric polymer, and the like. When the printhead 10 according to the embodiment of the present disclosure is used, different voltages may be applied to the tine 131, to deform the tine 131 to different degrees. In this way, the apex angle of the tine 131 may be changed so as to control the amount of the ink separated from the primary ink by the tine 131, to control the droplets falling onto the substrate through the secondary liquid discharging channel 12, especially the volume of the droplets falling onto the substrate through the secondary liquid discharging channel 12, thereby further facilitating the manufacturing of the display product with a higher resolution.

Further referring to FIG. 4 or FIG. 6, in the embodiments of the present disclosure, the printhead 10 further comprises a first static electricity generator 15 disposed on an opening of the secondary liquid discharging channel 12 away from the corresponding primary liquid discharging nozzle 111, i.e., a lower opening of the secondary liquid discharging channel 12 in FIG. 4 or FIG. 6. Therefore, when the first static electricity generator 15 generates static electricity, it may charge the branched droplet dropped onto the substrate through the secondary liquid discharging channel 12. If an electric field is formed between the printhead 10 and the stage for carrying the substrate in the printing equipment, and a direction of the electric field is configured to drive the charged branched droplet to move towards the stage, then the charged branched droplet is moved along the direction of the electric field to the substrate on the stage, so that a position of the branched droplet falling on the substrate can be controlled, and a speed of the branched droplet moving to the stage can be controlled, thereby improving the accuracy of the pattern formed on the substrate.

In the above embodiment, the primary droplet may be formed by the primary liquid discharging nozzle 111 in the primary liquid discharging assembly 11 in various manners. In the embodiment of the present disclosure, referring to FIG. 2, the channel wall of the primary liquid discharging channel 112 of the primary liquid discharging nozzle 111 is made of a piezoelectric material. For example, the material of the channel wall of the primary liquid discharging channel 112 can be chosen from piezoelectric ceramic, piezoelectric crystal, piezoelectric polymer, and the like. When the printhead 10 according to the embodiment of the present disclosure is used, the printing liquid is supplied into the primary liquid discharging assembly 11, and the printing liquid enters the primary liquid discharging channel 112 of the primary liquid discharging nozzle 111, and a voltage is applied to the channel wall of the primary liquid discharging channel 112 of the primary liquid discharging nozzle 111 to deform the channel wall of the primary liquid discharging channel 112 and compress the primary liquid discharging channel 112, thereby the printing liquid in the primary liquid discharging channel 112 is extruded to form the primary droplet. By applying different voltages to the channel wall of the primary liquid discharging channel 112, the channel wall of the primary liquid discharging channel 112 is deformed to different degrees to adjust the degree of compression of the primary liquid discharging channel 112, thereby adjusting the volume of the formed primary droplet.

Further referring to FIG. 1, the printhead 10 according to the embodiment of the present disclosure further comprises a partition plate 14 between the primary liquid discharging assembly 11 and the secondary liquid discharging channels 12, the partition plate 14 is provided with a plurality of through holes 141, the plurality of through holes 141 are in one-to-one correspondence with the plurality of primary liquid discharging nozzles 111, and a cross-sectional area of the through hole 141 is greater than a cross-sectional area of the primary liquid discharging channel 112 of the primary liquid discharging nozzle 111. The partition plate 14 is disposed in such a way that there is a certain distance between the primary liquid discharging nozzle 111 in the primary liquid discharging assembly 11 and the secondary liquid discharging channel 12, thus the opening of the primary liquid discharging channel 112 of the primary liquid discharging nozzle 111 close to the corresponding secondary liquid discharging channel 12 is spaced from the opening of the secondary liquid discharging channel 12 close to the corresponding primary liquid discharging nozzle 111 by a certain distance. A certain drop distance is prepared for the primary droplet formed by the primary liquid discharging nozzle 111 in the primary liquid discharging assembly 11 before the primary droplet enters the corresponding secondary liquid discharging channel 12, so that the primary droplet has time to form a spherical shape before entering the secondary liquid discharging channel 12 and after leaving the primary liquid discharging nozzle 111. Thus the primary droplet is spherical when entering the secondary liquid discharging channel 12, so that the tine 131 can effectively split the primary droplet when the primary droplet contacts with the tine 131, thereby the droplet falling on the substrate is controlled, especially the volume of the droplet falling on the substrate is controlled, to achieve a display product with a higher resolution.

Figure 7:
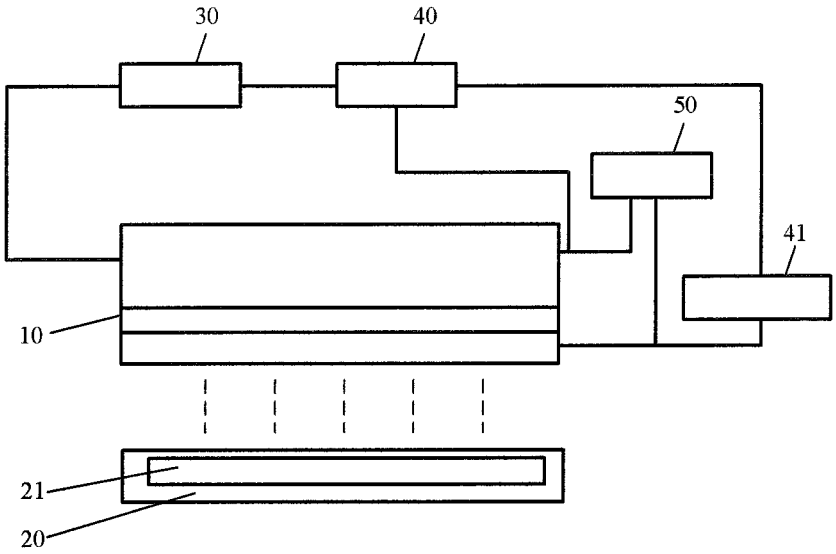
FIG. 7 is a schematic structural view of a printing equipment according to an embodiment of the present disclosure.

Referring to FIG. 7, an embodiment of the present disclosure further provides a printing equipment, comprising the printhead 10 according to the above embodiments.

The printing equipment has the same advantages as the above-mentioned printhead 10, therefore they will not be described repeatedly herein.

Figure 8:
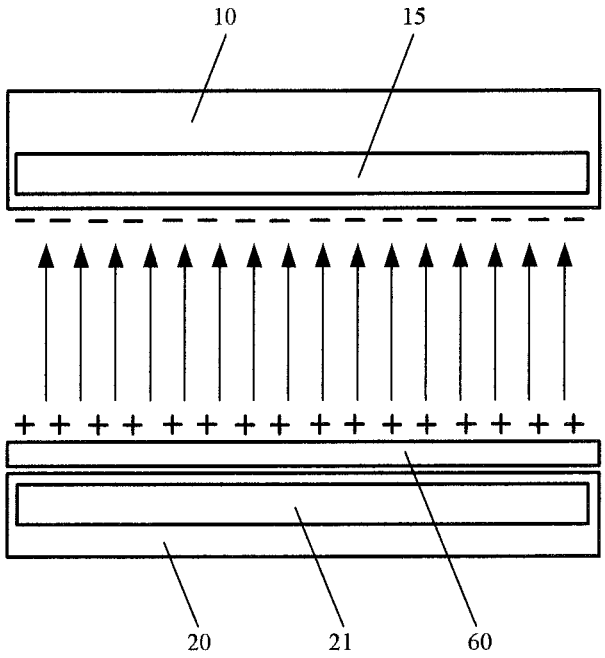
FIG. 8 is a schematic view of an electric field formed between a stage and a printhead in FIG. 7.
Figure 9:
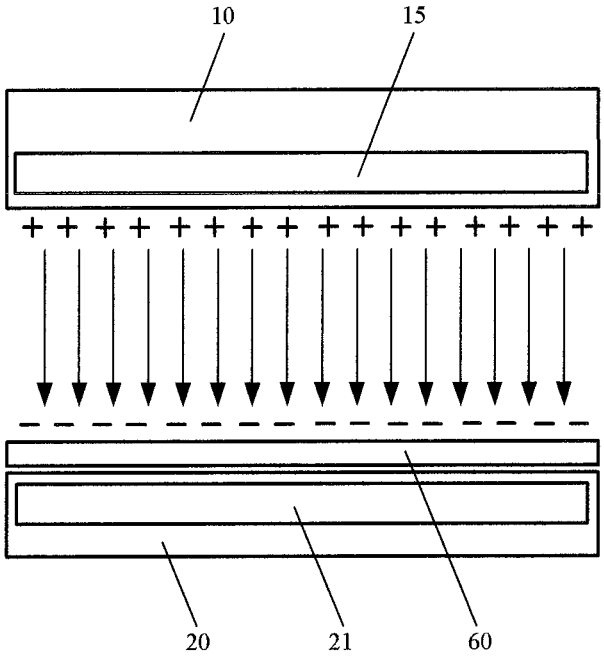
FIG. 9 is another schematic view of an electric field formed between a stage and a printhead in FIG. 7.

Further referring to FIG. 7, FIG. 8 and FIG. 9, the printing equipment according to the embodiment of the present disclosure further comprises a stage 20 located below the printhead 10, a second static electricity generator 21 is provided on the stage 20, and the second static electricity generator 21 is configured to generate an electrical property of static electricity that is opposite to an electrical property of static electricity generated by the first static electricity generator 15 in the printhead 10. For example, referring to FIG. 8, the static electricity generated by the first static electricity generator 15 in the printhead 10 is negative, thus the droplet flowing through the secondary liquid discharging channel 12 are negatively charged, and the static electricity generated by the second static electricity generator 21 on the state 20 is positive, thus an electric field directed upward is formed between the printhead 10 and the stage 20. The negatively charged droplet is driven to move towards the substrate 60 placed on the stage 20 under the action of the electric field between the printhead 10 and the stage 20. Alternatively, referring to FIG. 9, the static electricity generated by the first static electricity generator 15 in the printhead 10 is positive, thus the droplet flowing through the secondary liquid discharging channel 12 are positively charged, and the static electricity generated by the second static electricity generator 21 on the state 20 is negative, thus an electric field directed downward is formed between the printhead 10 and the stage 20. The positively charged droplet is driven to move towards the substrate 60 placed on the stage 20 under the action of the electric field between the printhead 10 and the stage 20.

With such a design, the first static electricity generator 15 is used to charge the droplet flowing through the secondary liquid discharging channel 12 so that the droplet flowing through the secondary liquid discharging channel 12 has charges, and an electric field is formed between the printhead 10 and the stage 20 by the static electricity generated by the first static electricity generator 15 and the static electricity generated by the second static electricity generator 21. Under the action of the electric field between the printhead 10 and the stage 20, the charged droplet is dropped along a straight line onto the substrate 60 placed on the stage 20, to form the corresponding pattern. Therefore, the arrangement of the first static electricity generator 15 and the second static electricity generator 21 can adjust the straightness of the droplet falling on the substrate 60 through the secondary liquid discharging channel 12, and adjust the magnitude of the static electricity generated the first static electricity generator 15 or/and the magnitude of the static electricity generated by the second static electricity generator 21, to adjust the magnitude of the electric field between the printhead 10 and the stage 20, to adjust the falling speed of the droplet falling on the substrate 60 through the secondary liquid discharging channel 12. In this way, the position at which the droplet falls on the substrate 60 through the secondary liquid discharging channel 12 and the shape of the droplet falling on the substrate 60 through the secondary liquid discharging channel 12 may be controlled, thereby improving the accuracy of the pattern formed on the substrate 60.

Further referring to FIG. 1 to FIG. 7, the printing equipment according to the embodiment of the present disclosure further comprises a liquid supply system 30, a recovery system 40, and a waste liquid system 50, wherein the liquid supply system 30 is communicated with a liquid inlet 113 of the primary liquid discharging assembly 11 of the printhead 10; the recovery system 40 is communicated with the liquid supply system 30, a liquid outlet 114 of the primary liquid discharging assembly 11 of the printhead 10, and a flow guiding slot 133 of the flow branching component 13 of the printhead 10, and a switching valve 41 is provided in a pipeline communicating the flow guiding slot 133 with the recovery system 40; and the waste liquid system 50 is communicated with the liquid outlet 114 of the primary liquid discharging assembly 11 and the flow guiding slot 133.

When the printing equipment according to the embodiment of the present disclosure is used, the printing liquid supplied by the liquid supply system 30 is introduced in the primary liquid discharging assembly 11 through the liquid inlet 113 of the primary liquid discharging assembly 11 of the printhead 10, and enters each primary liquid discharging nozzle 111 in the primary liquid discharging assembly 11, then a primary droplet is formed after passing through the primary liquid discharging nozzle 111, and the primary droplet enters the corresponding secondary liquid discharging channel 12 through the corresponding through holes 141 in the partition plate 14, and then falls on the substrate 60 placed on the stage 20 through the secondary liquid discharging channel 12, to form a corresponding pattern. One part of the printing liquid supplied to the primary liquid discharging assembly 11 from the liquid supply system 30 through the liquid inlet 113 of the primary liquid discharging assembly 11 forms the primary droplet by the primary liquid discharging nozzle 111, and the other part is introduced into the recovery system 40 through the liquid outlet 114 of the primary liquid discharging assembly 11, and then is introduced into the liquid supply system 30 through the recovery system 40, achieving ink recovery and utilization and reducing waste of material. The primary droplet formed by the primary liquid discharging nozzle 111 in the primary liquid discharging assembly 11 of the printhead 10 fall down through the corresponding through holes 141 in the partition plate 14, is split into two branched droplets by the flow branching component 13. One of the branched droplets is dropped onto the substrate 60 through the secondary liquid discharging channel 12, and the other branched droplet is directed into the flow guiding slot 133 outside the secondary liquid discharging channel 12. The printing liquid in the flow guiding slot 133 is recycled to the reflow system 40 under the action of the switching valve 41, and introduced through the recovery system 40 into the liquid supply system 30, achieving ink recovery and utilization and reducing waste of material. If it is necessary to clean the primary liquid discharging assembly 11 and the flow guiding slot 133, then the printing liquid remaining in the primary liquid discharging assembly 11 and the flow guiding slot 133 is collected by the waste liquid system 50, so as to clean the primary liquid discharging assembly 11 and the flow guiding slot 133, preventing the primary liquid discharging assembly 11 and the flow guiding slot 133 from being blocked.

Figure 10:
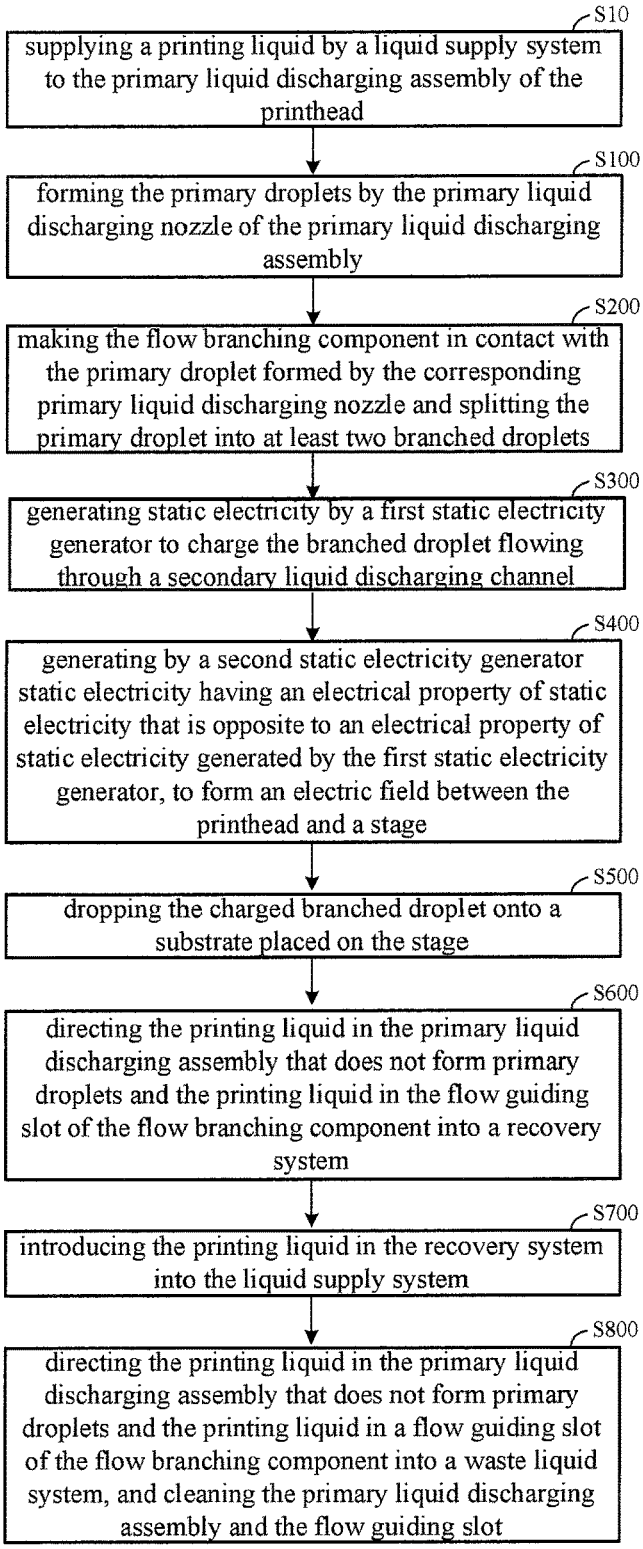
FIG. 10 is a flowchart of a printing method according to an embodiment of the present disclosure.

Referring to FIG. 10, an embodiment of the present disclosure further provides a printing method using the printing equipment according to the above embodiments. The printing method comprises:

Step S100: forming the primary droplets by the primary liquid discharging nozzle of the primary liquid discharging assembly; and Step S200: making the flow branching component in contact with the primary droplet formed by the corresponding primary liquid discharging nozzle and splitting the primary droplet into at least two branched droplets.

The printing method has the same advantages as the above-mentioned printing equipment, therefore they will not be described repeatedly herein.

Further referring to FIG. 10, after the step S200 of making the flow branching component in contact with the primary droplet formed by the corresponding primary liquid discharging nozzle and splitting the primary droplet into at least two branched droplets, the printing method further comprises:

Step S300: generating static electricity by a first static electricity generator to charge the branched droplet flowing through a secondary liquid discharging channel;

Step S400: generating by a second static electricity generator static electricity having an electrical property of static electricity that is opposite to an electrical property of static electricity generated by the first static electricity generator, to form an electric field between the printhead and a stage; and Step S500: dropping the charged branched droplet onto a substrate placed on the stage.

Further referring to FIG. 10, before the step S100 of forming the primary droplets by the primary liquid discharging nozzle of the primary liquid discharging assembly, the printing method further comprises:

Step S10: supplying a printing liquid by a liquid supply system to the primary liquid discharging assembly of the printhead;

Further referring to FIG. 10, after the step S200 of making the flow branching component in contact with the primary droplet formed by the corresponding primary liquid discharging nozzle and splitting the primary droplet into at least two branched droplets, the printing method further comprises:

Step S600: directing the printing liquid in the primary liquid discharging assembly that does not form primary droplets and the printing liquid in the flow guiding slot of the flow branching component into a recovery system; and Step S700: introducing the printing liquid in the recovery system into the liquid supply system.

Further referring to FIG. 10, the printing method according to the embodiment of the present disclosure further comprises:

Step S800: directing the printing liquid in the primary liquid discharging assembly that does not form primary droplets and the printing liquid in a flow guiding slot of the flow branching component into a waste liquid system, and cleaning the primary liquid discharging assembly and the flow guiding slot.

In the above description of the embodiments, specific features, structures, materials, or characteristics may be combined in any suitable manner in any one or more embodiments or examples.

The foregoing descriptions are merely specific implementation manners of the present disclosure, but the scope of the present disclosure is not limited thereto. Change or replacement may be easily made by the person skilled in the art within the technical scope disclosed in the present disclosure, and such change or replacement fall within the scope of the present disclosure. Therefore, the scope of the present disclosure should be defined by the claims.

What is claimed is:

1. A printhead, comprising:

a primary liquid discharging assembly, comprising a plurality of primary liquid discharging nozzles for forming primary droplets; and a plurality of flow branching components below the primary liquid discharging assembly, the plurality of flow branching components being provided together as a single unit that is detachable from the primary liquid discharging assembly and the plurality of flow branching components being in one-to-one correspondence with the plurality of primary liquid discharging nozzles, wherein each of the plurality of flow branching components is configured to be in contact with the primary droplet formed by the corresponding primary liquid discharging nozzle, and to split each of the primary droplets into at least two branched droplets.

2. The printhead according to claim 1, further comprising a plurality of secondary liquid discharging channels below the primary liquid discharging assembly, the plurality of secondary liquid discharging channels being in one-to-one correspondence with the plurality of flow branching components, wherein each of the flow branching components is located in a corresponding secondary liquid discharging channel of the plurality of secondary liquid discharging channels, and the each of the flow branching component is configured to separate the corresponding secondary liquid discharging channel into at least two branching channels, and in the at least two branched droplets formed from the primary droplet which is split by the each of the flow branching components, each of the branched droplets flows through a corresponding branching channel.

3. The printhead according to claim 2, wherein each of the flow branching components comprises a tine, and a tip of the tine is directed towards a corresponding primary liquid discharging nozzle of the plurality of primary liquid discharging nozzles.

4. The printhead according to claim 3, wherein a distance between a channel wall of each of the secondary liquid discharging channels and the corresponding primary liquid discharging nozzle is less than a distance between the tine and the corresponding primary liquid discharging nozzle.

5. The printhead according to claim 1, further comprising a plurality of secondary liquid discharging channels below the primary liquid discharging assembly, the plurality of secondary liquid discharging channels being in one-to-one correspondence with the plurality of flow branching components, wherein each of the flow branching components is located in an opening of a corresponding secondary liquid discharging channel of the plurality of secondary liquid discharging channels close to a corresponding primary liquid discharging nozzle of the plurality of primary liquid discharging nozzles, and in the at least two branched droplets formed from each of the primary droplets which is split by a corresponding flow branching component of the plurality of flow branching components, one of the branched droplets flows through the corresponding secondary liquid discharging channel, and the remaining branched droplets are diverted to an outside of the secondary liquid discharging channels.

6. The printhead according to claim 5, wherein each of the flow branching components comprises a tine disposed on a channel wall of the corresponding secondary liquid discharging channel, and a tip of the tine is directed towards the corresponding primary liquid discharging nozzle.

7. The printhead according to claim 6, wherein each of the flow branching components further comprises a shielding wall disposed on the channel wall of the corresponding secondary liquid discharging channel and facing the tine, and a distance between the shielding wall and the corresponding primary liquid discharging nozzle is less than a distance between the tine and the corresponding primary liquid discharging nozzle.

8. The printhead according to claim 6, wherein each of the flow branching components further comprises a flow guiding slot on a side of the tine facing away from the secondary liquid discharging channel.

9. The printhead according to claim 7, wherein the shielding wall is flush with a corresponding channel wall in channel walls of a primary liquid discharging channel of the corresponding primary liquid discharging nozzle, and a distance between the tine and the shielding wall is less than a distance between the channel wall corresponding to the shielding wall and the channel wall corresponding to the tine, in the channel walls of the primary liquid discharging channels of the primary liquid discharging nozzles.

10. The printhead according to claim 9, wherein the distance between the tine and the shielding wall is ⅓ to ¾ of the distance between the channel wall corresponding to the shielding wall and the channel wall corresponding to the tine, in the channel walls of the primary liquid discharging channels of the primary liquid discharging nozzles.

11. The printhead according to claim 6, wherein an apex angle of the tine is variable.

12. The printhead according to claim 2, further comprising a first static electricity generator on an opening of the secondary liquid discharging channel away from the corresponding primary liquid discharging nozzle.

13. The printhead according to claim 2, further comprising a partition plate between the primary liquid discharging assembly and the secondary liquid discharging channels, the partition plate being provided with a plurality of through holes, the plurality of through holes being in one-to-one correspondence with the plurality of primary liquid discharging nozzles, and a cross-sectional area of the through hole being greater than a cross-sectional area of the primary liquid discharging channel of the corresponding primary liquid discharging nozzle of the plurality of primary liquid discharging nozzles.

14. A printing equipment, comprising the printhead according to claim 1.

15. The printing equipment according to claim 14, wherein the printing equipment comprises a stage below the printhead, a second static electricity generator is on the stage, the printhead comprises a first static electricity generator, and the second static electricity generator is configured to generate an electrical property of static electricity that is opposite to an electrical property of static electricity generated by the first static electricity generator in the printhead.

16. The printing equipment according to claim 14, further comprising a liquid supply system, a recovery system, and a waste liquid system, wherein the liquid supply system is communicated with a liquid inlet of the primary liquid discharging assembly of the printhead;

the recovery system is communicated with the liquid supply system, a liquid outlet of the primary liquid discharging assembly, and a flow guiding slot of the flow branching components of the printhead, and a switching valve is provided in a pipeline communicating the flow guiding slot with the recovery system; and the waste liquid system is communicated with the liquid outlet of the primary liquid discharging assembly and the flow guiding slot.

17. A printing method using the printhead according to claim 1, wherein the printing method comprises:

forming the primary droplets by the primary liquid discharging nozzles of the primary liquid discharging assembly; and making each of the flow branching components in contact with the primary droplet formed by the corresponding primary liquid discharging nozzle and splitting the primary droplet into at least two branched droplets.

18. The printing method according to claim 17, wherein, after making each of the flow branching components in contact with the primary droplet formed by the corresponding primary liquid discharging nozzle and splitting the primary droplet into at least two branched droplets, the printing method further comprises:

generating static electricity by a first static electricity generator to charge the branched droplets flowing through secondary liquid discharging channels;

generating by a second static electricity generator static electricity having an electrical property of static electricity that is opposite to an electrical property of static electricity generated by the first static electricity generator, to form an electric field between the printhead and a stage; and dropping the charged branched droplets onto a substrate placed on the stage.

19. The printing method according to claim 17, wherein, before forming the primary droplets by the primary liquid discharging nozzles of the primary liquid discharging assembly, the printing method further comprises:

supplying a printing liquid by a liquid supply system to the primary liquid discharging assembly of the printhead;

after making each of the flow branching components in contact with the primary droplet formed by the corresponding primary liquid discharging nozzle and splitting the primary droplet into at least two branched droplets, the printing method further comprises:

directing the printing liquid in the primary liquid discharging assembly that does not form primary droplets and the printing liquid in the flow guiding slot of the flow branching component into a recovery system; and introducing the printing liquid in the recovery system into the liquid supply system.

20. The printing method according to claim 17, further comprising:

directing the printing liquid in the primary liquid discharging assembly that does not form primary droplets and the printing liquid in a flow guiding slot of the flow branching component into a waste liquid system, and cleaning the primary liquid discharging assembly and the flow guiding slot.

* * * * *